United States Patent [19]

Higgins

[11] Patent Number: 4,746,267

[45] Date of Patent: May 24, 1988

[54] PUMP ARRANGEMENTS

[75] Inventor: George H. Higgins, Lemington Spa, England

[73] Assignee: Godiva Fire Pumps Limited, Warwick, England

[21] Appl. No.: 843,477

[22] Filed: Mar. 24, 1986

[30] Foreign Application Priority Data

Feb. 28, 1986 [GB] United Kingdom ..... 8604970

[51] Int. Cl.[4] ..... F04D 29/10

[52] U.S. Cl. ..... 415/140; 415/170 A; 415/201; 92/128; 277/9

[58] Field of Search ..... 415/170 A, 174, 131–133, 415/140, 173 R, 201; 277/1, 9, 9.5, 27, 65; 92/128, 131

[56] References Cited

U.S. PATENT DOCUMENTS

| | | | |
|---|---|---|---|
| 1,945,825 | 2/1934 | Saxe | 415/170 A |
| 2,418,184 | 4/1947 | McConaghy | 415/199.6 X |
| 3,088,416 | 5/1963 | Danis | 415/132 |
| 3,402,671 | 9/1968 | Wilfley et al. | 415/170 A |
| 3,410,565 | 11/1968 | Williams | 415/170 A |
| 3,914,072 | 10/1975 | Rowley et al. | 415/201 X |
| 4,501,530 | 2/1985 | Rockwood et al. | 415/170 A |

FOREIGN PATENT DOCUMENTS

| | | |
|---|---|---|
| 219316 | 4/1925 | United Kingdom . |
| 614599 | 12/1948 | United Kingdom . |
| 625898 | 7/1949 | United Kingdom . |
| 903904 | 8/1962 | United Kingdom . |
| 1074923 | 7/1967 | United Kingdom . |
| 1074940 | 7/1967 | United Kingdom . |

*Primary Examiner*—Robert E. Garrett
*Assistant Examiner*—Joseph M. Pitko
*Attorney, Agent, or Firm*—Millen & White

[57] ABSTRACT

A pump arrangement comprises a housing, a rotary impeller in the housing, an input shaft coupled to the rotary impeller for connection to a drive shaft, a mechanical seal having engaging surfaces for sealing between said input shaft and said housing, and a disengaging device operable to disengage said surfaces. The invention is particularly applicable to fire pumps.

15 Claims, 2 Drawing Sheets

PUMP ARRANGEMENTS

The present invention relates to pump arrangements and is applicable, inter alia, to fire pumps.

A centrifugal fire pump conventionally comprises an outer housing within which is mounted a rotatable impeller coupled to an input shaft for connection to a prime mover or drive source which may be for example a diesel engine or an electric motor.

It is useful to allow the prime mover to be used to drive other equipment and the most commonly used method of achieving this is to provide separate drives from the prime mover with a separate clutch to each piece of driven equipment. Thus, only the drive to the required equipment will be engaged at any one time. This solution requires a bulky and heavy prime mover and is therefore costly and is particularly inconvenient when the pump set is required to be portable.

An alternative solution is to couple the prime mover only to the fire pump and to provide an output shaft from the fire pump to which auxiliary equipment may be connected. With such an arrangement however it is impossible to drive the auxiliary equipment without also operating the pump and this necessitates that water is continuously passed through the pump even when no water pumping is required. If no water is passed through the pump, heat generated at the rubbing surfaces of the pump shaft seal will very quickly lead to destruction of the seal.

An object of the invention is to provide a simple method of driving auxiliary equipment without the need to pass liquid through the pump.

Another object of the invention is to provide a pump arrangement having a pump shaft seal which arrangement can transmit drive from a prime mover to auxiliary equipment without destruction of the pump shaft seal and without the need to pump any liquid.

According to one aspect of the invention, there is provided a pump arrangement comprising: housing means; a rotary member in the housing means coupled to an input shaft for connection of a drive source; mechanical sealing means having engaging surfaces for sealing between said input shaft and said housing means; and disengaging means operable to disengage said surfaces.

Preferably, said sealing means comprises a first member mounted on the housing means and a second member mounted on the input shaft for sliding contact with said first member.

Preferably, the input shaft extends to form a mounting shaft for said rotary member.

Preferably, said rotary member is an impeller means.

Preferably, said mounting shaft is accessible from the exterior of said housing means to form an output shaft for connection to auxiliary equipment.

In a preferred embodiment of the invention, the disengaging means is mounted within the shaft of said impeller means and is expediently hydraulically operable, for example in response to coupling of said output shaft to auxiliary equipment.

The disengaging means expediently comprises a plunger movable axially of the shaft and hydraulically coupled for displacing that member of the sealing means mounted on the shaft.

Preferably the member of the sealing means mounted on the shaft is resiliently biased to an engaging position.

For a better understanding of the invention, and to show how the same may be carried into effect, reference will now be made by way of example to the accompanying drawings, in which.

Figure 1:
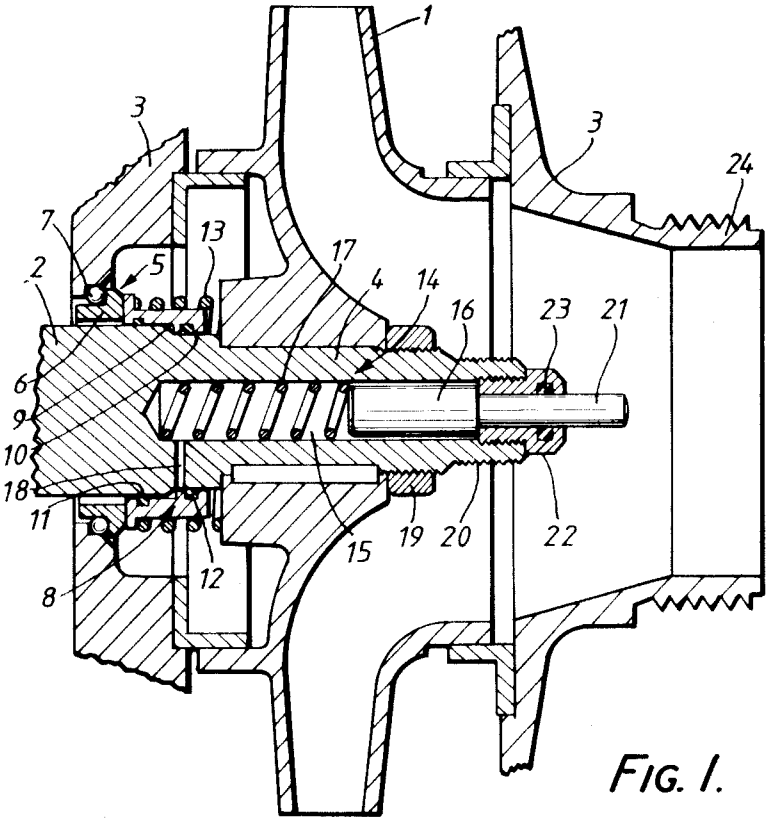
FIG. 1 is a longitudinal sectional view, partially cut away, of a centrifugal pump arrangement in accordance with one embodiment of the invention.

Referring to FIG. 1 in more detail, a centrifugal fire pump comprises a rotary impeller 1 mounted within a housing 3. An input shaft 2 is provided for coupling to a prime mover (not illustrated) such as a diesel engine or an electric motor. The input shaft 2 extends axially through the housing 3 and provides a mounting spindle 4 for the impeller 1. A sealing assembly 5 is provided to seal between the shaft 2 and the housing 3. The seal assembly 5 is a mechanical shaft seal comprising a stationary member 6 of carbon or ceramic material sealed to the housing 3 by an O-ring 7 and a stainless steel rotating member 8 slidably mounted on the surface of shaft 2 in the region of an inwardly extending shoulder 9 leading to a shaft portion 10 of reduced diameter. Two O-rings 11 and 12 seal the rotating member 8 against the shaft surface. A spring 13 biases the rotating member 8 in a leftward direction in FIG. 1 into sliding engagement with the stationary member 6. Thus, the seal assembly 5 is able to prevent the egress of liquid during operation of the pump.

Located within the impeller shaft spindle 4 is provided a seal disengaging device 14. This device comprises a chamber 15 and a slidable piston or plunger 16 which is biased to the right in FIG. 1 by means of a coil spring 17. Chamber 15 contains a hydraulic fluid and communicates via a channel 18 to an annular chamber formed between the inner surface of the rotating member 8 of the seal assembly and the outer surface of the shaft 2 in the region of its portion 10 or reduced diameter.

It will be appreciated that the shaft 4 is splined for reception of the impeller 1 which is secured firmly in position by an impeller retaining nut 19. The shaft 4 extends beyond the nut 19 to provide a further region 20 which may be splined or serrated for coupling to secondary or auxiliary equipment. The plunger 16 is connected to a displacement rod 21 which protrudes from the section 20 through a sealing member 22 which contains an internal O-ring 23. The shaft portion 20 is accessible via the pump suction tube 24.

Before the operation of the described construction is explained, reference will be made to FIG. 2 which schematically illustrates a longitudinal sectional view through an item of auxiliary equipment.

The auxiliary equipment is provided with an input shaft 30 having an internal coupling zone 31 for engagement with the splined or recessed portion 20 of the impeller shaft 4. Furthermore, the shaft 30 has an internal slidable plate member 32 which is resiliently biased in an outward direction by a spring 33 for a purpose which will be explained hereinafter.

Figure 2:
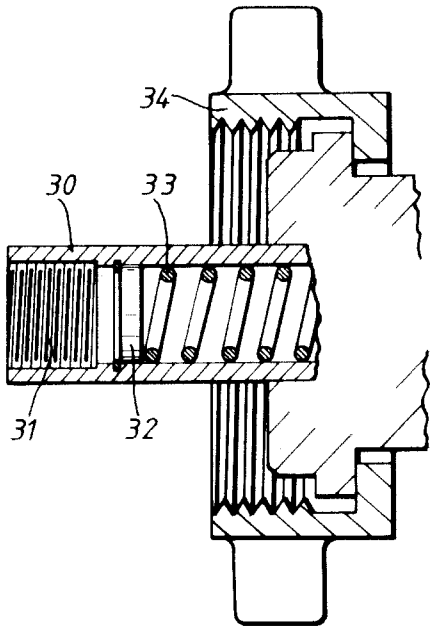
FIG. 2 is a schematic longitudinal sectional view, partially cut away, through auxiliary equipment for coupling to the pump arrangement.

In order to couple the auxiliary equipment of FIG. 2 to the pump of FIG. 1, the shaft 30 is inserted through the suction tube 24 until the coupling section 31 engages with the portion 20 of shaft 4. During this engagement process, the plate member 32 engages with the displacement rod 21 and pushes the latter in a leftward direction as viewed in FIG. 1. This causes the piston 16 to pressurize the hydraulic fluid in the chamber 15 which pressure communicates via the channel 18 to the annular chamber formed within the rotating sealing member 8 as hereinbefore described.

This pressurizing action causes the rotating member 8 to move towards the right as viewed in FIG. 1, thus disengaging the rotating member 8 from the stationary member 6. Naturally, this pressurizing action requires very slight leftward movement of the displacement rod 21, whilst full engagement between shaft 30 and shaft portion 20 requires an appreciable degree of axial relative movement. To accommodate this relative movement, the plate member 32 is able to slide inwardly of shaft 30 against the force of spirng 33.

Figure 3:
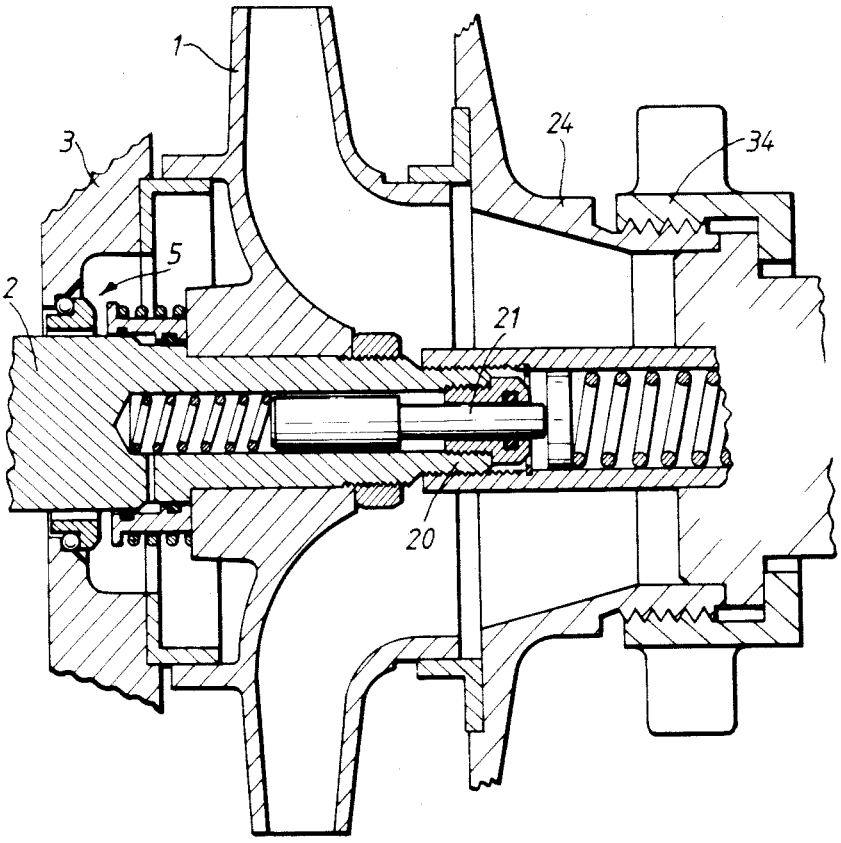
FIG. 3 is a longitudinal sectional view, partially cut away, showing the pump arrangement and auxiliary equipment of FIGS. 1 and 2 in a coupled condition.

FIG. 3 shows the auxiliary equipment coupled to the pump arrangement with the seal assembly 5 in its disengaged condition.

Thus, in summary, the act of attaching the secondary auxiliary equipment moves the rod 21 axially within the pump shaft and this movement is transmitted hydraulically to the rotating member of the mechanical pump shaft seal to move it out of contact with the stationary member.

During the coupling process, a housing portion 34 of the secondary equipment is coupled to the pump suction tube 24 either by a flange or a threaded connection.

Thus, the auxiliary equipment may be driven by a prime mover coupled to the input shaft 2 of the pump arrangement via the intermediary of the impeller of the pump without the need to pump liquid for the purpose of cooling the shaft seal. It will be appreciated that if the engaging surfaces of the seal arrangement 5 were not disengaged, transmitting drive via the impeller in this manner would rapidly lead to overheating of the seal arrangement 5 and consequent damage in the absence of liquid flowing through the pump arrangement. The present invention thus enables coupling of the prime mover to the auxiliary equipment in a simple manner without the need to pump any liquid. Furthermore, the disengaging action of the seal arrangement 5 occurs completely automatically in response to coupling of the auxiliary equipment to the output shaft of the pump arrangement.

Although in the preferred embodiment illustrated and discussed above this decoupling action takes place automatically, it is also conceivable within the scope of the invention that the decoupling may be initiated manually or by some other means as a separate action following coupling of the auxiliary equipment. This will allow the user the option of operating both the auxiliary equipment and the pump arrangement should the need arise. Alternatively, the same result could be achieved by so constructing the auxiliary equipment as to enable coupling to the shaft portion 20 without applying pressure to the displacement rod 21.

The invention is applicable to the driving of various items of auxiliary or secondary equipment such as a desmoking fan for blowing smoke or a hydraulic pump.

Any conventional form of coupling between the pump input shaft 2 and the prime mover, such as splines or serrations, may be employed.

The desmoking fan may driven by a flexible shaft coupled to the pump arrangement, or, where a hydraulic pump is coupled, the desmoking fan may be driven hydraulically. Furthermore, a hydraulic pump coupled to the described and illustrated arrangement may be operated to drive hydraulic jacks, or cutting gear, or a submersible pump. A submersible pump may be required if the water source for the fire pump is too low to be lifted by the fire pump alone. The submersible pump then is lowered to the water source and lifts the water to the fire pump. In this case, of course, it is not desired to decouple the engaging surfaces of the mechanical shaft seal. On the other hand, where a submersible pump is utilized to pump flood water, the fire pump is not required to undertake any pumping operations and the mechanical shaft seal should therefore be disengaged as described above.

Many further variations and modifications will occur to those skilled in the art and all such modifications as fall within the scope of the invention are to be regarded as within the scope of the appended claims.

I claim:

1. A coupling arrangement for coupling a pump arrangement to further equipment, the coupling arrangement having a first coupling member comprising: a first rotatable shaft; a hydraulic chamber in said shaft; and piston means within said shaft, said piston means having a part extending from said shaft and being displaceable to pressurize said hydraulic chamber, and the coupling arrangement having a second coupling member for coupling to the first member and comprising a second rotatable shaft having a surface for engaging said part of said piston means during coupling.

2. An arrangement according to claim 1 wherein said surface is displaceable axially of said second displaceable shaft.

3. An arrangement according to claim 2 wherein said surface is on a member mounted within a recess of said second shaft.

4. An arrangement according to claim 3 wherein said surface is resiliently biased towards the first shaft.

5. An arrangement according to claim 2 wherein said surface is resiliently biased towards the first shaft.

6. An arrangement according to claim 1 including further apparatus wherein said chamber is coupled to effect hydraulic operation of said further apparatus upon displacement of said piston means.

7. An arrangement according to claim 6 wherein said further apparatus comprises a disengageable mechanical shaft seal.

8. Pump apparatus for pumping fluids comprising:

housing means;

a rotary member located within said housing means;

an input shaft drivingly coupled to said rotary member to transmit rotary motion thereto;

mechanical sealing means forming a seal between said housing means and said input shaft, and including a pair of engaging surfaces;

connection means on said input shaft adapted to couple said input shaft to auxiliary equipment exterior of said housing means; and disengaging means mounted within said input shaft and operable to disengage said pair of surfaces thereby breaking said seal when said input shaft is coupled to said auxiliary equipment by said connection means.

9. Pump apparatus according to claim 8 wherein said input shaft extends to form a mounting portion for said rotary member, and extends further to form an output portion for connection to said auxiliary equipment, said output portion being accessible from the exterior of said housing means.

10. Pump apparatus according to claim 8 wherein said disengaging means is hydraulically operable.

11. Pump apparatus according to claim 8 wherein said disengaging means is operable automatically upon coupling of said input shaft to said auxiliary equipment.

12. Pump apparatus according to claim 8 wherein said sealing means comprises a first member mounted on said housing means and a second member mounted on said input shaft, said second member being in sliding contact with said first member.

13. Pump apparatus according to claim 12 wherein said second member is resiliently biased to a position for effecting said sliding contact.

14. Pump apparatus according to claim 13 wherein said disengaging means comprises a plunger movable axially of said input shaft and hydraulically coupled for displacing said second member of said sealing means mounted on said input shaft.

15. Pump apparatus according to claim 8 wherein said rotary member is an impeller.

* * * * *